US011089854B2

(12) United States Patent
Spector et al.

(10) Patent No.: US 11,089,854 B2
(45) Date of Patent: Aug. 17, 2021

(54) MULTIFUNCTIONAL REPLACABLE PANEL ASSEMBLY FOR BAGS

(71) Applicant: SHELL CASE LIMITED, Hong Kong (CN)

(72) Inventors: Yuval Spector, Bahan (IL); Eyal Hilel Bar Erez, Gan Yoshiya (IL)

(73) Assignee: SHELL CASE LIMITED, Hong Kong (CN)

( * ) Notice: Subject to any disclaimer, the term of this patent is extended or adjusted under 35 U.S.C. 154(b) by 0 days.

(21) Appl. No.: 17/143,317

(22) Filed: Jan. 7, 2021

(65) Prior Publication Data

US 2021/0127809 A1 May 6, 2021

Related U.S. Application Data

(63) Continuation of application No. PCT/IL2019/050791, filed on Jul. 14, 2019.
(Continued)

(51) Int. Cl.
*A45C 13/08* (2006.01)
*A45C 13/10* (2006.01)
*A45C 13/00* (2006.01)

(52) U.S. Cl.
CPC ..... *A45C 13/08* (2013.01); *A45C 13/001* (2013.01); *A45C 13/10* (2013.01)

(58) Field of Classification Search
CPC ..... A45C 13/08; A45C 13/10; A45C 13/001
(Continued)

(56) References Cited

U.S. PATENT DOCUMENTS 2,302,560 A 11/1942 Latona
2,522,549 A 9/1950 Waggoner
(Continued)

FOREIGN PATENT DOCUMENTS

CN 2477025 2/2002
CN 105708070 A 6/2016
(Continued)

*Primary Examiner* — Sue A Weaver

(57) ABSTRACT

This invention is directed to a multi-functional replaceable panel assembly for a bag allowing a user to add a functionality to the bag and/or to vary its appearance. The multi-functional replaceable panel assembly comprising: (a) at least two rail profiles, each rail profile is attached to a bag and comprises at least one elongated strip that is made of at least one flexible material, wherein upon attachment of the elongated strip to the bag, a protruding rim is created at the interface between each one of the elongated strips and the bag, said protruding rims are positioned one toward the other to functionally allow inserting and holding of a replaceable panel below them; and (b) at least one replaceable panel having dimensions suitable to be inserted into the space created between said two protruding rims of the at least two rail profiles and the bag, wherein said replaceable panel is stably being held by the two protruding rims and provides the bag with additional functionality and/or a different appearance; wherein, the same or different panel are replaced by the user according to his need upon usage. This invention is further directed to a modular bag comprising a multifunctional replaceable panel assembly.

18 Claims, 9 Drawing Sheets

Related U.S. Application Data

(60) Provisional application No. 62/711,683, filed on Jul. 30, 2018.

(58) Field of Classification Search
USPC ..... 150/104, 105; 190/102, 108; 224/153
See application file for complete search history.

(56) References Cited

U.S. PATENT DOCUMENTS

| | | | | | |
|---|---|---|---|---|---|
| 4,673,070 | A * | 6/1987 | Ambal | A45C 3/00 | 150/111 |
| 5,465,839 | A * | 11/1995 | Gretz | A63B 55/408 | 206/315.3 |
| 5,628,443 | A * | 5/1997 | Deutsch | A45C 7/0086 | 150/113 |
| 6,629,629 | B2 * | 10/2003 | Lee | A45F 3/04 | 224/583 |
| 9,380,845 | B2 | 7/2016 | Sheikh et al. | | |
| 2003/0179569 | A1 * | 9/2003 | Huang | A45C 13/08 | 362/109 |
| 2006/0273757 | A1 * | 12/2006 | Naguib | A45C 15/00 | 320/107 |
| 2007/0080183 | A1 | 4/2007 | Lafoux et al. | | |

FOREIGN PATENT DOCUMENTS

| | | |
|---|---|---|
| FR | 978474 | 4/1951 |
| FR | 1108023 A | 6/1956 |

* cited by examiner

MULTIFUNCTIONAL REPLACABLE PANEL ASSEMBLY FOR BAGS

FIELD OF THE INVENTION

The present invention is in the field of bags in general. More particular, it is directed to a novel multifunctional assembly for bags comprising at least one replaceable panel and at least two directional rail profiles for assembly of the at least one panel onto the bag.

BACKGROUND

Modular bags that allows addition of parts and components to standard bags are known in the art. Such modular bags provide solutions that are sometimes cumbersome and change the entire structural appearance of the bag, expensive and therefore they are unreachable to most people. One optional solution is described in FR978474 that is a limited solution for handbags that allows replacement of the entire bag wall for aesthetic reasons. As such the replacing panel is limited to be replaced only on two walls of the bag. In more detail, this patent (denoted hereinafter: "474") is directed to a handbag with transformations, while the present invention may be implemented in all kinds of bags including handbags, backpacks, luggage's, purses, and else. The handbag disclosed in 474 appears at first, as a common model while the bag with the multifunctional replaceable panel has a unique appearance with the replaceable panel assembly visible onto it wither with replaceable panel within it or without a panel, having the bag's fabric visible between at least two rail profiles. Additional difference is that in 474 all materials can be used while in the present invention only flexible materials that maintain the soft structure of the bag are suitable. Also, in the 474 patent the two slides are on the front and back sides only, a series of two-sided panels, or one side, visible or hidden depending on the model, while in the present invention the number of replaceable panels is not limited to one or two, as it is not replacing the side wall of the bag but rather additional part, and it may be positioned on each and every side of the bag. From the same reason, in 474 the slides are designed as two flat portions of the bag (front and back) and have exactly the shape of the bag. The replaceable panels of the present invention have only partial shape of the front/other surface of the bag.

Some further attempts have been made as described in the following patents and applications that may be relevant to the field of the invention: FR1108023(A), CN105708070 (A), U.S. Pat. No. 2,302,560(A), and U.S. Pat. No. 2,522, 549(A).

In all references mentioned above, the frame holding the slides and the slides, well as the mechanism for attaching the slide are very rigid, and a have a significant appearance on the bag, like external faces, and as such interrupt with the soft structure of the bag and its original design. The rigid structure is usually encompassing the entire surface of the bag side to either cover it or replace it.

Thus, there is a constant need for a simple and intuitive solution for adding functionalities and changing the appearance of a bag without changing the bag's flexible structure and soft appearance, that will be easy to use and achievable to everyone. The present invention is aimed to provide such a flexible, simple and low-cost solution that doesn't interrupt with the basic bag structure.

The present invention provides in one main aspect, a novel multifunctional replaceable panel assemble that is formed from soft and flexible materials which doesn't impact the flexibility and natural soft filling of the bag, like the other solutions available in the market, and can be integrated into the bag, like part of its construction. The bag having the novel multi-functional replaceable panel assembly of the invention maintain its natural look and function with or without the use of the replaceable panels.

SUMMARY OF THE INVENTION

In one main aspect, the present invention teaches a novel way to add additional functions to the common traditional functions of a bag, such as solar charging, light reflection, flashlight, audio platform, hanging straps, and the like, and further to provide a way to vary the appearance of the bag, in an easy to use and low-cost solution that maintains the flexibility of the bag. The addition and removal of various functionalities and appearances to the bag are made according to the user preferences and needs at a specific usage of the bag. The term "Bag" as used herein includes backpack, trolley bags, handbags, package bags and covers, wallets, school bags, suitcases and any other type of bag that allows attachment of multifunctional replaceable panel assembly (denoted hereinafter: "MRPA") as will be described in detail hereinbelow. The term "Panel" as used herein includes any type of insert having certain functionality or decorative appearance that is configured and operable to be reversibly inserted into or positioned onto at least two rail like elements attached to a bag, creating a sliding route to the panel, such that the panel is stably positioned on the bag without changing. Examples of various panels are described hereinbelow.

In accordance with embodiments of the invention, a novel MRPA is provided. Optionally, the MRPA comprises at least two rail profiles sutured or otherwise attached to the outer or inner surface of a bag to functionally create pathway for inserting a replaceable panel with dimensions matching to the distance between the two rail profiles, into the space created between the rail profiles and the bag or on top of the rail profiles such that the replaceable panel clinches the rails in a stable manner. In accordance with embodiments of the invention the replaceable panel may be used as an improvement to provide the bag with additional functionalities, such as but not limited to: solar charging, night alarm indication, mechanical strengthening construction, hanging straps to provide additional carrying abilities to the bag, and the like. The MRPA may also be used to vary the appearance of the bag and to personalize it.

In accordance with some embodiments of the invention, the composition of the rail profiles as well as the rail profiles' visual appearance and usage may vary, as will be described in detail with reference to the drawings hereinbelow.

In accordance with one main aspect of the invention, a multi-functional replaceable panel assembly for a bag allowing a user to add a functionality to the bag and/or to vary its appearance, said multifunctional replaceable panel assembly comprising:

a. At least two rail profiles, each rail profile is attached to a bag and comprises at least one elongated strip that is made of at least one flexible material, wherein upon attachment of the elongated strip to the bag, a protruding rim is created at the interface between each one of the elongated strips and the bag, said protruding rims are positioned one toward the other to functionally allow inserting and holding of a replaceable panel below them; and
b. at least one replaceable panel having dimensions suitable to be inserted into the space created between said two protruding rims of the at least two rail profiles and the bag, wherein said replaceable panel is stably being held by the two protruding rims and provides the bag with additional functionality and/or a different appearance;

wherein, the same or different panel are replaced by the user according to his need upon usage.

In some embodiments, the protruding rims of each of the at least two rail profiles may be positioned in opposite direction, each one facing the outer sides of the bag to functionally create a rail like structure allowing inserting and holding the replaceable panel on top of them.

Preferably but not necessarily, the elongated strips are stitched to the bag's fabric. The elongated strip in some embodiments, may be made of a flexible polymer covered with a fabric.

In some non-limiting examples, thee one or more of the following features: solar panel for charging, light reflector for darkness hours, colored panel for decoration, panel with a pattern for decoration, panel with letters for personalization; panel with hanging loops, panel with flash light, panel with audio player, and a panel with a speaker, a panel with a case, a panel with a flexible LCD like display, a panel with a clock. It should be clear that other optional features may be implemented and are within the scope of this invention.

In some preferred embodiments, the at least two rail profiles are positioned on the outer surface of the bag. In some other embodiments, they may be positioned within the inner surface of the bag. The at least two rail profiles may be positioned on any wall of the bag.

In some preferred embodiments, the at least two rail profiles are integrated to the bag structure, however, they may be separated therefrom.

The distance between the rail profiles may vary in width and length.in some specific embodiments, the at least two rail profiles are detachable strips that can be positioned onto the bag in various distances to match different sizes of panels.

In some further embodiments, the at least one of the elongated strips creating the rail profiles further allows the attachment of accessories.

The present invention in one another main aspect is directed to a bag comprising a multi-functional replaceable panel assemble according to the above description. In some specific embodiments, the invention is directed to a modular bag comprising a multi-functional replaceable panel assembly allowing a user to add a functionality to the bag and/or to vary its appearance, said multifunctional replaceable panel assembly comprising:

a. At least two rail profiles, each rail profile is attached to a bag and comprises at least one elongated strip that is made of at least one flexible material, wherein upon attachment of the elongated strip to the bag, a protruding rim is created at the interface between each one of the elongated strip and the bag, said protruding rims are positioned one toward the other to functionally allow inserting and holding of a replaceable panel below them; and b. at least one replaceable panel having dimensions suitable to be inserted into the space created between said two protruding rims of the at least two rail profiles and the bag, wherein said replaceable panel is stably being held by the two protruding rims and provides the bag with additional functionality and/or a different appearance;

wherein, the same or different panel are replaced by the user according to his need upon usage.

In some embodiments, the protruding rims of each of the at least two rail profiles of the modular bag are positioned in opposite direction, each facing the outer sides of the bag to functionally create a rail like structure allowing inserting and holding the replaceable panel on top of them.

In some optional embodiments, the elongated strip of the rail profile is stitched to the bag's fabric and made of either one of a fabric, a flexible polymer, or a flexible polymer covered with a fabric. In some embodiments, the at least two rail profiles are integrated to the modular bag structure or separated therefrom. The distance between the rail profiles may vary in width and length.

In some specific embodiments, the at least two rail profiles are detachable strips that can be positioned onto the bag in various distances to match different sizes of panels.

In some further optional embodiments, the elongated strips of the rail panels further allow the attachment of accessories.

BRIEF DESCRIPTION OF THE DRAWING

FIGS. 2A-2F are schematic illustrations of some optional structures of MRPA in accordance with variations of the invention, in which the rails profile vary together with the connection to the bag's fabric for creation of a functional pathway for insertion of replaceable panels, in accordance with embodiments of the invention; wherein FIG. 2A illustrates one optional rail profile with an obtuse angle and a folded fabric structure; FIG. 2B illustrates a rail profile having two turns structure of about 90 degree, and a folded fabric structure; FIG. 2C illustrates the rail profile of FIG. 2A covered with fabric for providing the bag an aesthetic appearance and further for creating a protective layer to the rail profiles; FIG. 2D illustrates rail profiles made of flexible polymer covered with a fabric and folded at the internal side to create a stable rail like structure, with additional folded fabric structure that covers the rail profile at the stitching area; FIG. 2E illustrates an alternative structure similar to the structure of FIG. 2D in which the flexible polymer has a circular shape that results in an alternative rail structure; FIG. 2F illustrates additional variation in which rail profiles are positioned on the bag with the protruding rims facing the external sides of the bag and the panel inserted is covering the rail profiles clinching them from their upper side.

FIG. 3A-3C are schematic illustrations of a backpack comprising a MRPA in accordance with embodiments of the invention showing sequence of insertion of the replaceable panel through the rail profiles and the outer surface of the bag, wherein, FIG. 3A illustrates the bag and the inserted panel before insertion; FIG. 3B illustrates the replaceable panel being partially inserted through the two rail profiles; and FIG. 3C illustrates the replaceable panel fully inserted into the space created between the two rail profiles and the bag outer surface, providing a unique appearance to the bag.

FIG. 4A illustrates a MRPA located at the front side of a backpack; FIG. 4B illustrates a MRPA located at the front side of a suitcase on the lower pocket outer surface; and FIG. 4C illustrates a MRPA positioned at the side wall of a suitcase.

FIG. 5A illustrates, as an example, two straps for hanging a tripod on the outer front surface of a backpack; FIG. 5B illustrates, as an example, a replaceable hanging straps used for carrying an exercise mat; and FIG. 5C illustrates, as an example, a hanging strap for hanging a helmet on the outer front surface of a backpack.

FIGS. 6A-6C are illustrations of various examples of different patterns of a solar replaceable panel, wherein, FIG. 6A illustrates, horizontal solar cells with a graphical picture of a net of lines separating between the cells; FIG. 6B illustrates horizontal solar cells configuration; and FIG. 6C illustrates a vertical solar cells configuration.

DESCRIPTION OF VARIATIONS OF THE INVENTION

Figure 1A:
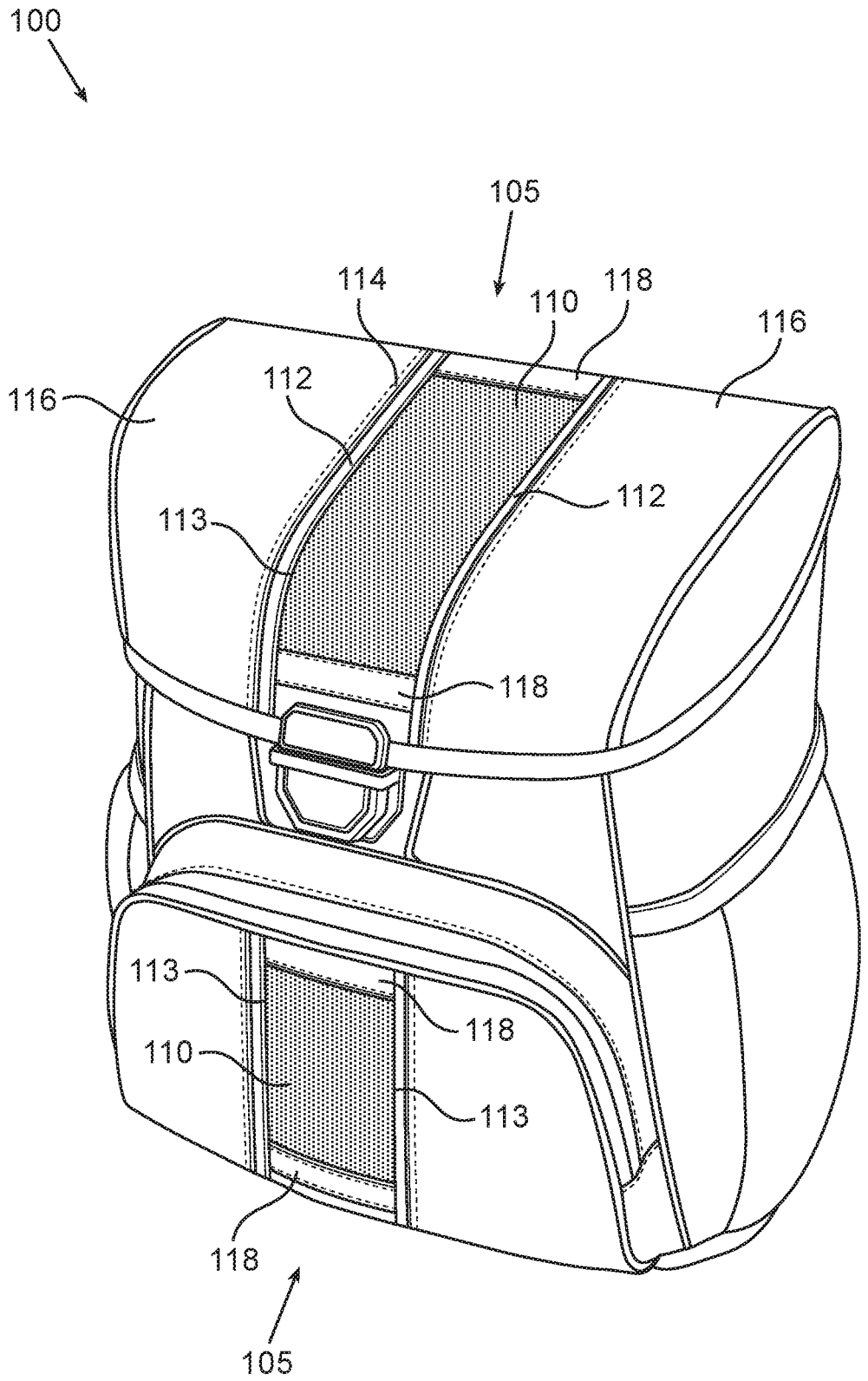
FIG. 1A is a schematic illustration of one optional example of a bag having two MRPAs, one positioned at the upper front side of the bag and the other at the lower front side of the bag.

In the following description, various aspects of a novel MRPA will be described. The MRPA of the invention comprises at least one replaceable panel and at least two rail profiles that create a path for insertion of the replaceable panel. The insertable replaceable panel in accordance with embodiments of the invention may have a functionality, such as but not limited to, solar panel for charging, a reflector for safety at darkness hours, hanging stand panel, flashlight panel, audio panel, LCD screen panel and else, or it can have a decorative function having for example, different color, pattern, letters, 3D shapes and mixtures thereof.

For the purpose of explanation, specific configurations and details are set forth in order to provide a thorough understanding of the invention.

In one optional embodiment, the replaceable panel may serve to provide a personalized touch of the person using the bag. Options fulfilling such functionality may be for example, having the name written on the replaceable panel, or a unique design painted on it, changing colors or pattern according to the appearance of the user, etc.

The replaceable panel may be painted personally, for example, by the user, or it may be ordered and printed by a dedicated printing shop or in common sell points. The replaceable panel may be a pre-designed print that the user purchase from a collection of panels or a printed by order of picture, images or designs.

In accordance with additional embodiment of the present invention, the printing may be done directly on the replaceable panel, or alternatively printed on a sticker that will be attached by the user to the replaceable panel.

In accordance with additional embodiment of the present invention the replaceable panel may serve additional functionalities such as a solar panel for charging an internal battery that can serve as a charger for cellular phone, tablet or other devices needed to be charged.

In accordance with additional embodiment of the present invention the replaceable panel may serve additional functionalities such as a mechanical strengthening functionality.

In accordance with additional embodiment of the present invention, one bag may have several replaceable panel assemblies.

In accordance with additional embodiment of the present invention, one bag may have several replaceable panels that are switched according to the user preferences.

Further examples of panels and functionalities will be described with reference to the Figures hereinbelow.

Although various features of the disclosure may be described in the context of a single embodiment, the features may also be provided separately or in any suitable combination. Conversely, although the disclosure may be described herein in the context of separate embodiments for clarity, the disclosure may also be implemented in a single embodiment. Furthermore, it should be understood that the disclosure can be carried out or practiced in various ways, and that the disclosure can be implemented in embodiments other than the exemplary ones described herein below. The descriptions, examples and materials presented in the description, as well as in the claims, should not be construed as limiting, but rather as illustrative. Terms for indicating relative direction or location, such as "right" and "left", "up" and "down", "top" and "bottom", "horizontal" and "vertical", "higher" and "lower", and the like, may also be used, without limitation.

Reference is now made to the figures.

FIG. 1A is a schematic illustration of one optional example of a bag 100 having two sets of MRPA 105, one positioned at the upper front side of the bag and the other positioned at the lower front side of bag 100. Each MRPA 105 is composed of at least two rail profiles 112, each rail profile 112 is an elongated strip that is made of at least one flexible material and attached to bag 100. In the specific example illustrated in this figure, rail profile 112 is being sewed to the bag's fabric 116 by stich 114. Upon attachment of the rail profile 111 to bag 100, a protruding rim 113 is created at the interface between each one of the rail profile and bag 100 creating a space that allows inserting and holding of a replaceable panel 110 below them, in a stable manner. In other words, the two protruding rims 113 function when they are positioned one toward the other, function as a stopper and allow to insert below them replaceable panel 110 in a simple and stable manner.

Replaceable panel 100 in accordance with embodiments of the invention is preferably having dimensions suitable to be inserted into the space created between the two protruding rims 113 of two rail profiles 112 and bag 100, wherein replaceable panel 110 is stably being held by the two protruding rims 113 and provides the bag with additional functionality and/or a different appearance. The same or different panel may be replaced by a user according to his need upon usage of the bag.

In more details, rail profile 112 may be composed in some embodiments of the invention, of a semi rigid material like a polymer (e.g. polypropylene, polyethylene, polyvinylchloride), a thermoplastic rubber, and the like. Optionally, rail profile 112 may be composed of a flexible metal, such as but not limited to, aluminum or stainless steel. In further embodiments, rail profile 112 may be made of a fabric that is thick enough to create a stable rim. Rail profiles 112 function as an open pocket as they create a space for insertion of replaceable panel 110 in a stable manner through them. Replacement of the replaceable panel 110 allow the user to personalize the bag and/or to add a functionality to the bag according to the user preferences and needs at a specific time point in an easy and simple manner as will be described in detail below. Upon insertion of the replaceable panel, rail profiles 112 serve as a fixation mechanism for stably holding the replaceable panel 110 onto the bag in a predetermined position outside and/or inside the bag. In some embodiments, rail profiles 112 may be positioned in a non-parallel positioning creating a pathway for a matching replaceable panel 110.

Replaceable panel 110 may be composed various material. Some none limiting examples are polymers such as polypropylene, polyethylene, polyvinylchloride, a thermoplastic rubber, and else. Replaceable panel 110 in some embodiments may be coated with printed material or textile. Alternatively, its outer surface may be covered by a sticker. Optionally, the lower and upper edges of replaceable panel 110 may be hidden by a cover 118 that may also be stitched or otherwise attached to the bag's fabric.

In a further embodiment of the invention, replaceable panel 110 may have a pincer shape at the edges that allows to hold the protruding rims 113 of rail profiles 112 in between them at each side.

Figure 1B:
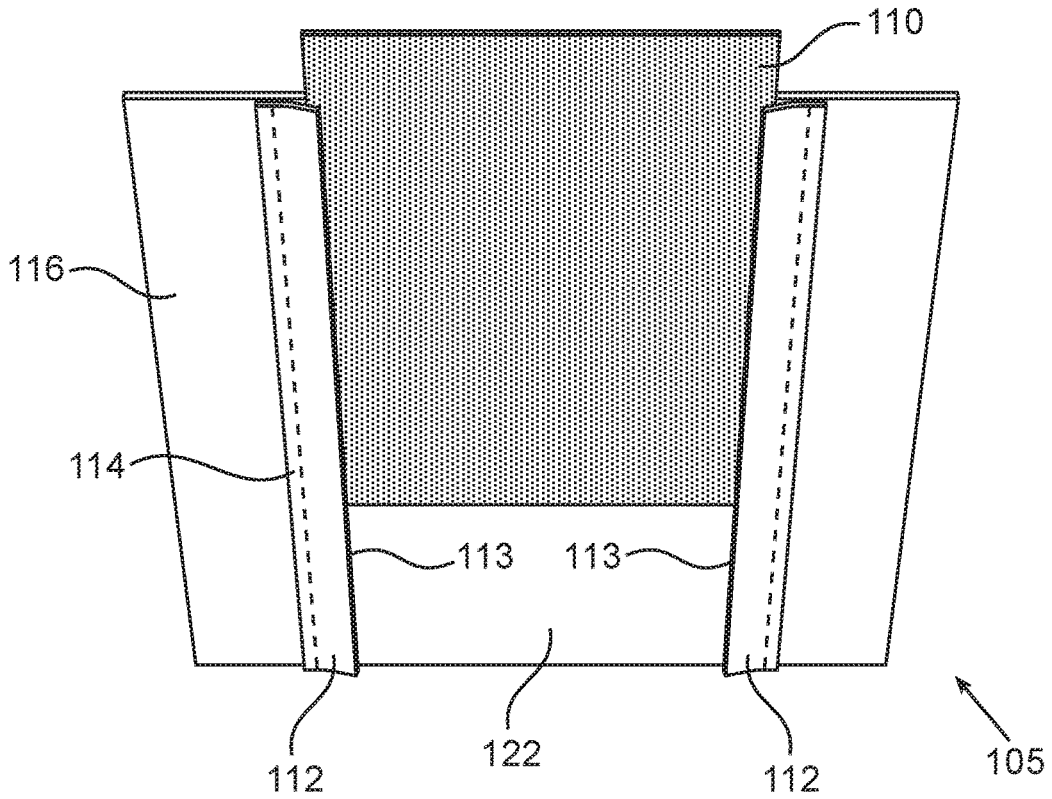
FIG. 1B is a schematic close-up view of the MRPA of FIG. 1A in one optional basic embodiment, comprising two rail profiles with protruding rims positioned one toward the other, to create a directional path structure and a replaceable panel inserted below the two protruding rims into the space created between the bag outer surface and the two rail profiles.

FIG. 1B is a schematic close-up view of MRPA 105 of FIG. 1A in accordance with one optional embodiment. As shown in the figure, MRPA 105 comprising two rail profiles 112 and a replaceable panel 110. In the specific example illustrated herein, each of rail profiles 112 upon stitching it to the bag fabric 116 by stitch 114, creates a protruding rim 113 that together with the protruding rim 113 of the second rail profile create a functional pathway for insertion of a replaceable panel 110. Preferably but not necessarily, rail profiles 112 are integral parts of the bag and as such, they are attached to the bag at the manufacturing process and delivered to the user while being attached. The user may choose to use the bag with a replaceable panel or without it. In some other embodiments, the rail profiles are detachable and can be added to the bag or removed therefrom as additional assembly. When inserting the replaceable panel into the space created between the bag fabric and the two protruding rims the replaceable panel covers the fabric of the bag 122 below the replaceable panel.

FIGS. 2A-2F are schematic illustrations of some optional structures of MRPA 105 in which the rail profile 112 vary together with the connection to the bag's fabric 116 as will be described hereinbelow.

Figure 2A:
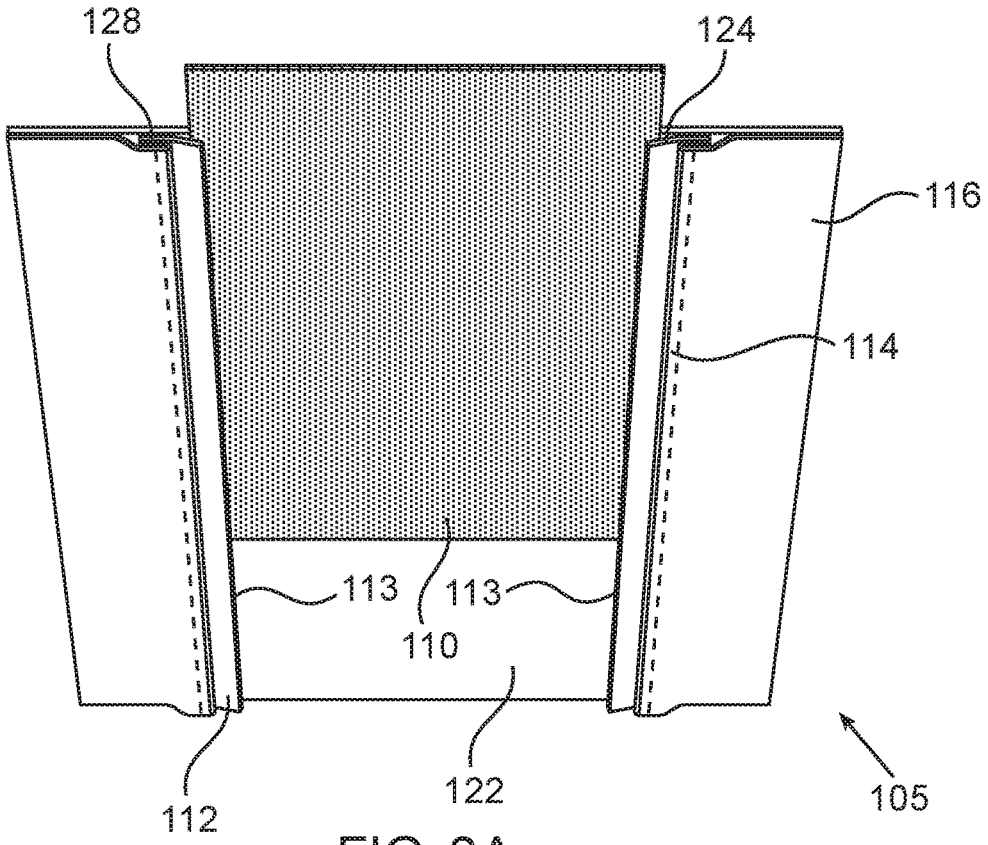

FIG. 2A illustrates one optional structure of rail profile 112 with an obtuse angle 124 at the connection interface with the bag and a folded fabric structure 128 of the bag's fabric attached to it to cover part of rail profile 112 leaving the protruding rim 113 uncovered. In this option the folded fabric 128 creates a solid substructure that allows to sew rail profile 112 together with the bag fabric in a convenient manner. Also shown in this figure are replaceable panel 110 and the bag fabric 122 that is partially covered by replaceable panel 110.

Figure 2B:
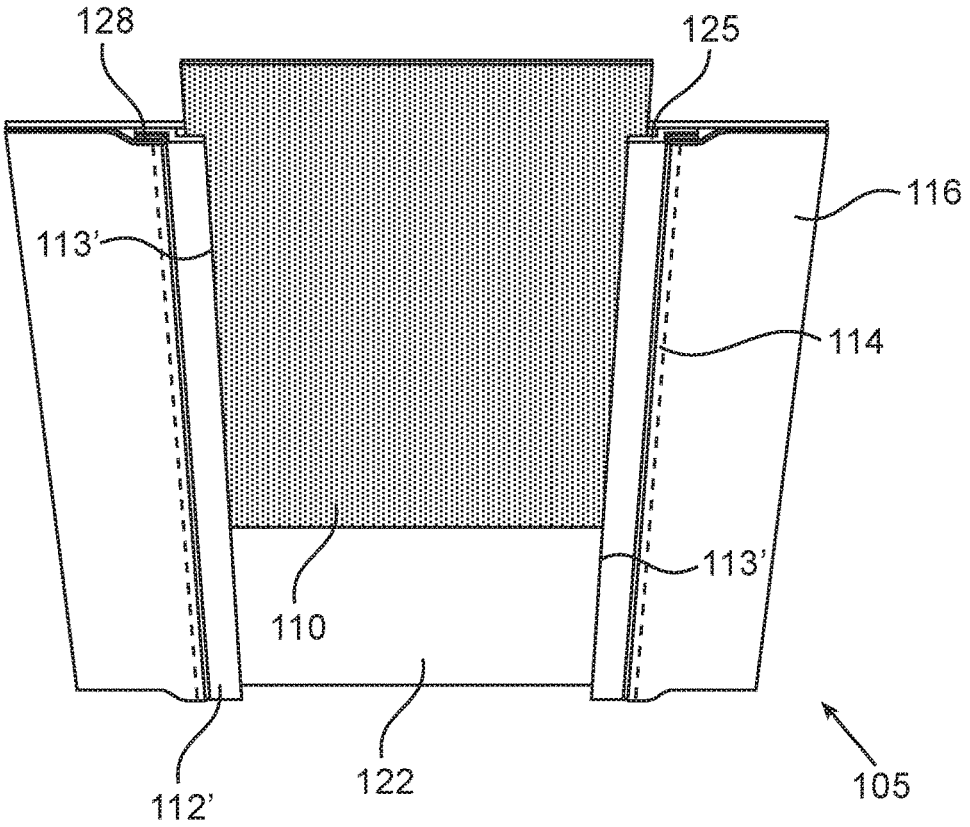

FIG. 2B illustrates additional optional rails profile 112' in which, the rail profile is having a step like structure 125. Such rail profile structure enables the inner part of the profile to be stitched to the bag fabric 116 by sutures 114 easily, by connecting the folded part of the bag fabric structure 128 to the inner part of the rail profile, while the outer part of rail profile 112', that is distant from the fabric creates a protruding rim 113' for inserting and holding replaceable panel 110 on top of bag fabric 122 that is hidden below the panel. It should be clear that folded fabric structure 123 is only a none limiting optional example, and rail profile 112' may be attached to an unfolded fabric as well.

Figure 2C:
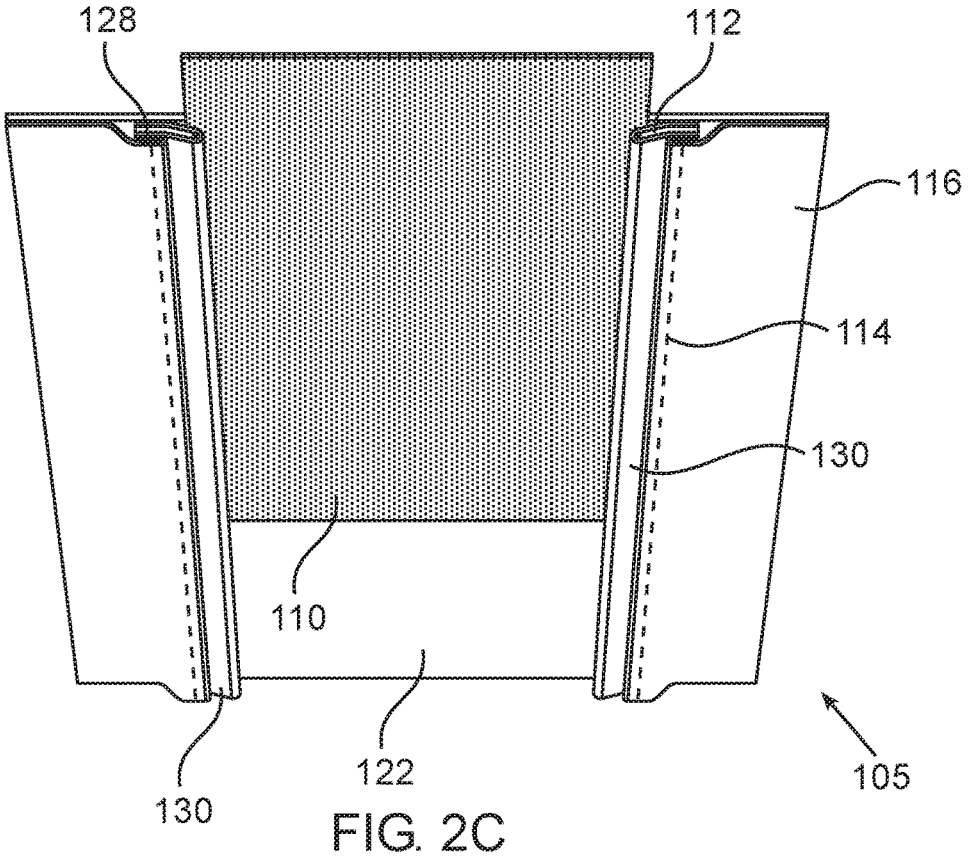

FIG. 2C illustrates additional variation, in which rail profile 112 of FIG. 2A is covered by a cover 130. Cover 130 may be a fabric or any other flexible material suitable for coating the rail profile. Cover 130 has at least three functional features. First, it creates a protective layer on the rail profile; second it enables a more aesthetic appearance of the bag, and third it enables an easy suturing of the fabric of the cover to the bag. Also shown in this figure are replaceable panel 110, the bags fabric 122 partially covered by replaceable fabric 110, the bag fabric 116 that is attached to rail profile 112 by stitches 114 at the foldable fabric area 128.

Figure 2D:
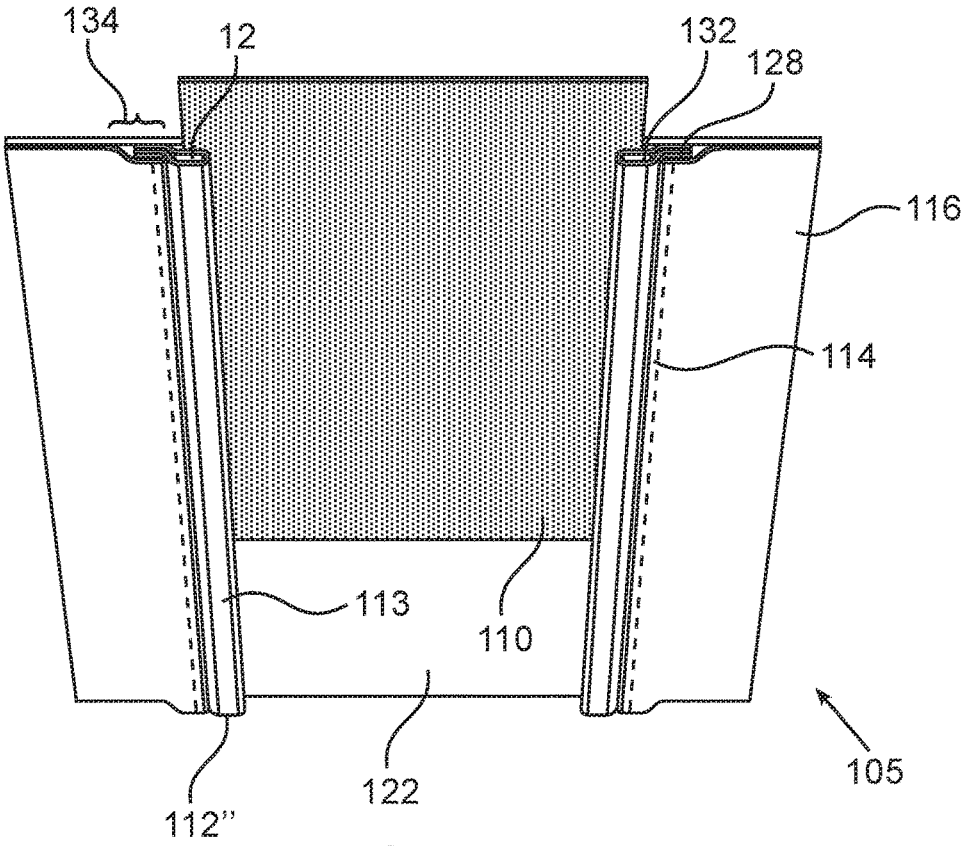
Figure 2E:
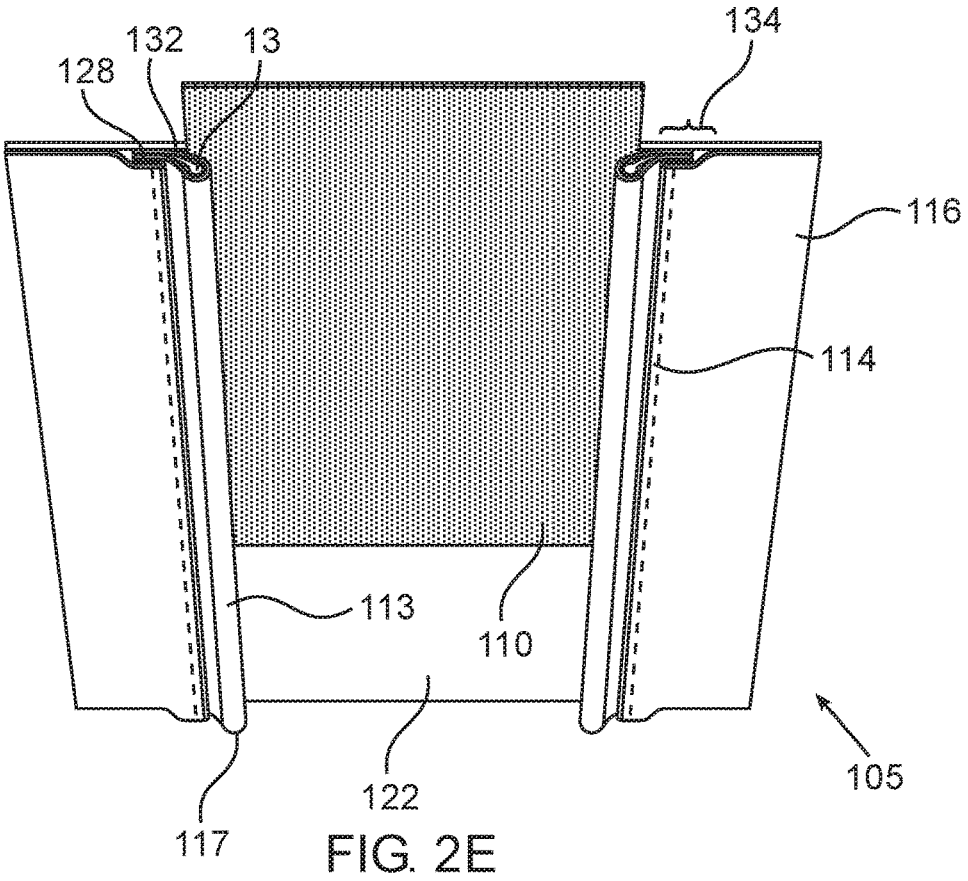

FIGS. 2D-2E illustrate rail profiles 112" and 117 respectively that are made of fabric 132 covering an elliptical flexible polymer 12, and a round flexible polymer 13 respectively, for creating a multi-layer rail profile with enlarged protruding rim 113. Rail profiles 112" and 117 are attached to the bag by folded fabric structure 128 at the stitching area 134. Also shown in these figures are sutures 114, bag's fabric 116, replaceable panel 110, and bag's fabric 122 that is partially covered by replaceable panel 110. The patterns illustrated in FIGS. 2D-2E have a simple shape of a rail, easy for manufacturing.

Figure 2F:
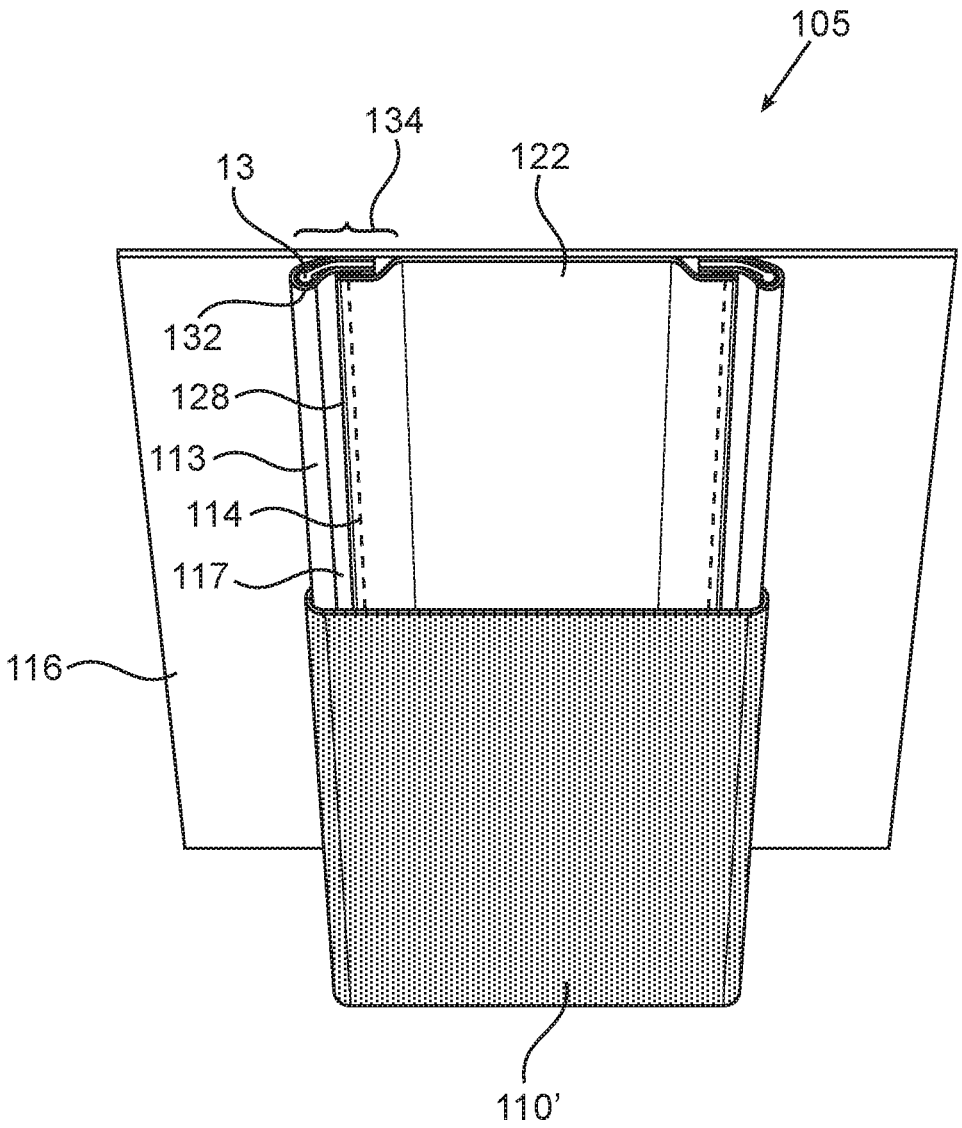
Figure 3C:
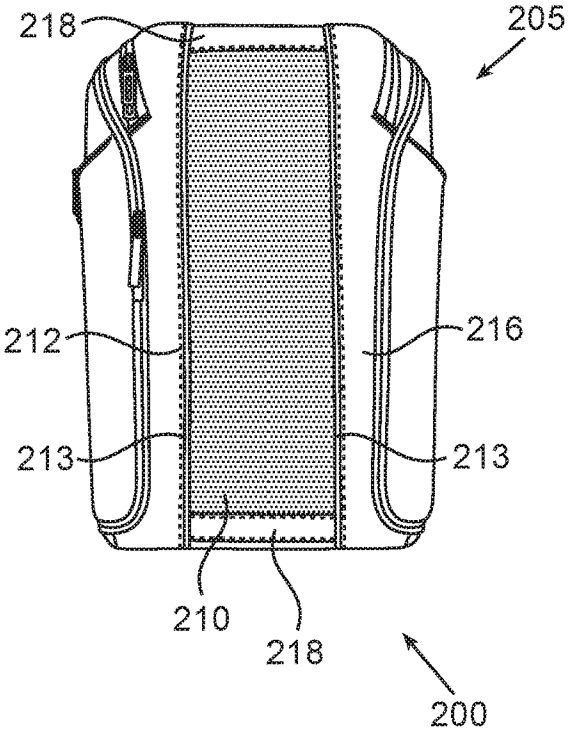
Figure 3B:
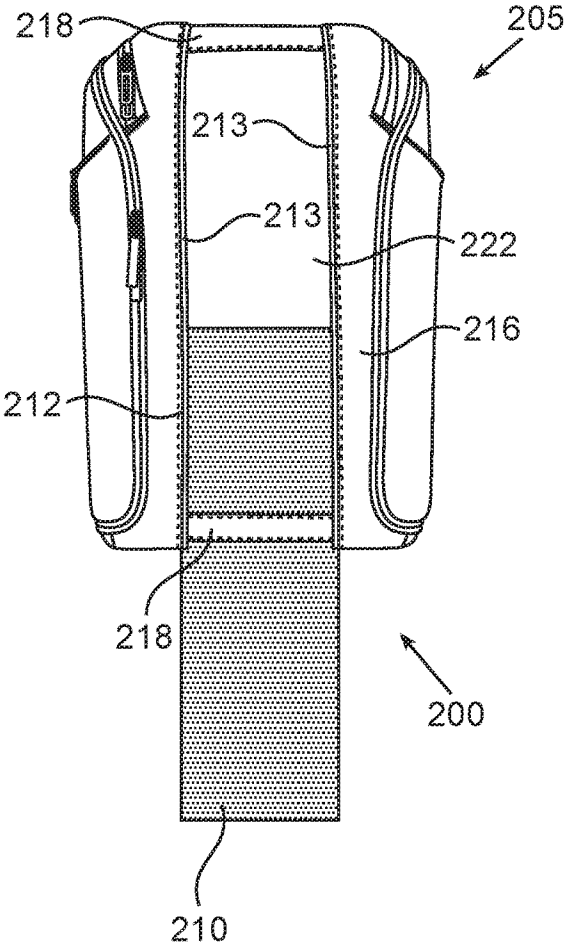
Figure 3A:
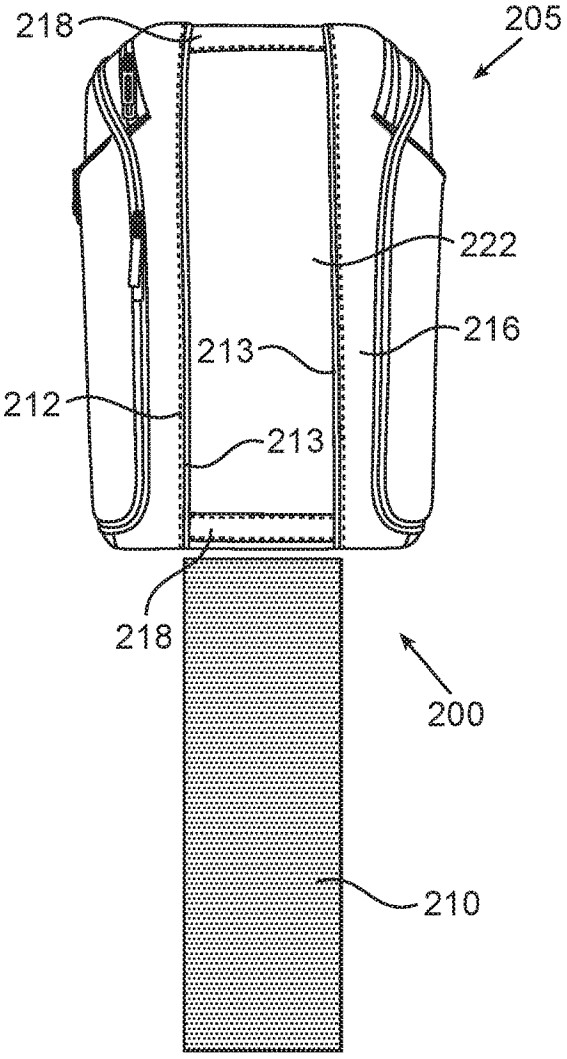

FIG. 2F illustrates one another optional example of a MRPA 105, in which the rail profiles are stitched to the bag in a manner that protruding rims 113 are positioned in opposite direction, each one facing the outer sides of the bag, to functionally create a rail like structure allowing inserting and holding on top of them a replaceable panel 110'. In this embodiment, replaceable panel 110' covers both the bag fabric 122' and the rail profiles 117. In the specific example illustrated in this figure, rail profile 117 has a similar structure as the rail profiles illustrated in FIG. 2E but positioned one relative to the other in opposite direction facing the outer sides of the bag and not facing each other as in FIG. 2E the rail profile 117 is a multi-layer profile with a flexible rounded polymer 13 covered by fabric 132 and stitched to the bag along stitching area 134 by stitches 114 to the bag fabric 116 and further to bag fabric 122 that in this specific example has a folded area 128 that covers the inner part of rail profile 117 for aesthetic appearance, while protruding rim 113 remain uncovered. The enlarged protruding rim illustrated in FIGS. 2E and 2F may also be used as rails for attaching various straps for hanging different objects and accessories to the bag. FIG. 3A-3C are schematic illustrations of backpack 200 comprising a MRPA 205 in accordance with embodiments of the invention showing a sequence of the insertion of replaceable panel 210 into the space created between protruding rims 213 of at least two rail profiles 212 and the bag fabric 222 in accordance to some embodiments of the invention.

In some embodiments of the invention, MRPA 205 is positioned on the front side of backpack 200 that comprise two rail profiles 212 stitched to the fabric 216 as described in detail with reference to FIGS. 1A-1B and 2A-2E. The time points illustrated in these figures are prior to the insertion of replaceable panel 210 (FIG. 3A), during the insertion of replaceable panel 210 through rail profiles 212 (FIG. 3B), and after the insertion of replaceable panel 210 is completed (FIG. 3C). The positioning of the MRPA 205 at the front side of the backpack allows the user to replace the panel and personalize the backpack according to his preferences at the time of usage of the backpack, and further to add some features, such as but not limited to, charging and/or safety alerting at night to the backpack. Cover strips 218 are optional additions and may cover the bottom and upper edges of replaceable panel 210 for providing the bag with aesthetic appearance. Along the progress of the insertion of replaceable panel 210, fabric 222 positioned at the area between the two rail profiles 212 is gradually covered by replaceable panel 210 and changes from fully visible to partially visible up to fully covered respectively. Also shown in these figures are protruding rims 213 and bag fabric 216.

Figures 4A, 4B, 4C:
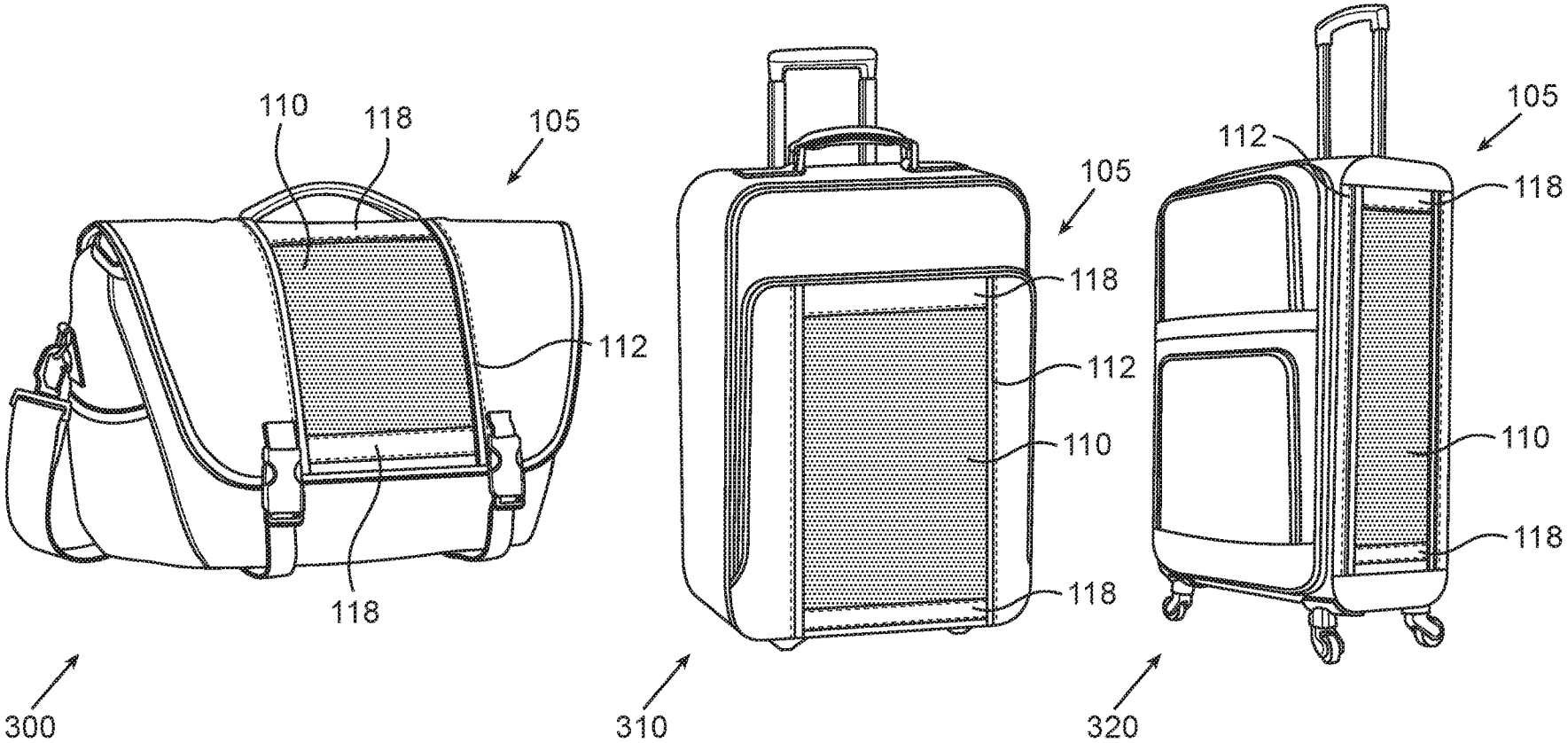
FIGS. 4A-4C are schematic illustrations of various examples of integration of MRPAs in different bags and alternative positions on the bag.

FIGS. 4A-4C are schematic illustrations of various examples of integration of MRPAs 105 in different bag types and various positions on the bag. It should be clear that the examples provided in these figures are only illustrative examples and other positioning of the MRPA and orientation, dimensions and shapes are also within the scope of the present invention. FIG. 4A illustrates one MRPA 105 located at the front side of a shoulder bag 300. The two rail profiles 112 are parallel to each other. Replaceable panel 110 is rectangular. In this example replaceable panel 110 may serve as an aesthetic improvement to the shoulder bag 300, that allows the user to personalize bag 300 and insert a chosen panel from a panel collection he/she has. Alternatively, replaceable panel 110 may serve as a sign of the bag owner by having its name or logo. In further embodiment, the replaceable panel 110 may be an advertisement for some product, service, and the like. The content presented on the replaceable panel 110 may be printed by the manufacturer, it may be painted manually by the user, or it may be designed by the user and manufactured by the manufacturer or else. Optionally, the edges of replaceable panel 110 are covered by cover 118 that may serve as an aesthetic improvement to the look by hiding the upper and lower edges of replaceable panel 110 and further as a tightening mechanism to keep replaceable panel 110 at its proper position. FIGS. 4B-4C illustrate integration of MRPA 105 in suitcases, at the front part of a suitcase 310 on the lower pocket at the front side (FIG. 4B), and at the side wall of suitcase 320 (FIG. 4C). As in FIG. 4A, the two rail profiles 112 are parallel to each other and perpendicular to the floor. Replaceable panel 110 is rectangular, and the content may serve as a decorative element for the suitcase that may further assist the user to recognize it easily during traveling. Other usages of replaceable panel 110 may be implemented in accordance to any other usage mentioned above.

Figure 5C:
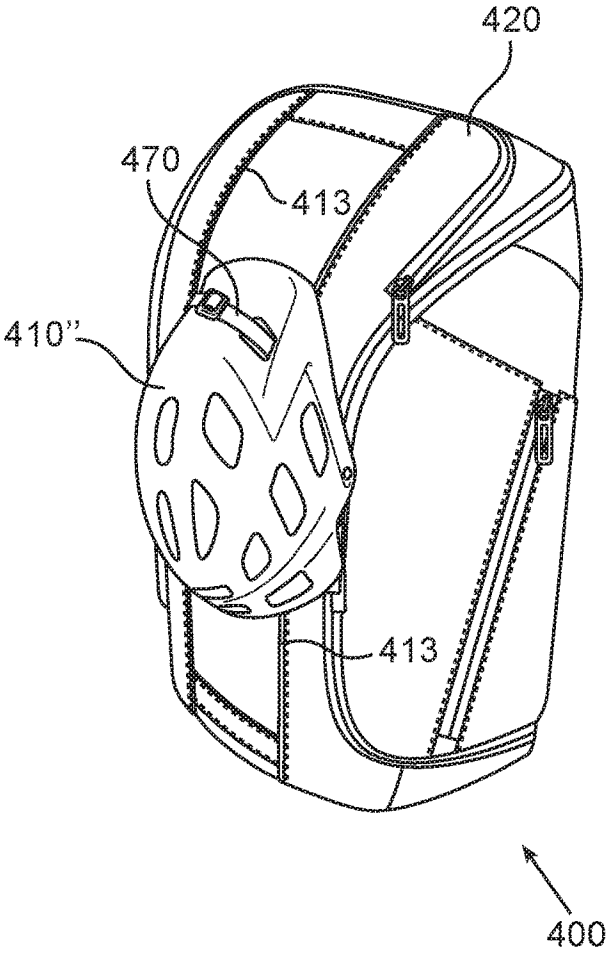
FIGS. 5A-5C are illustrations of optional examples of detachable hanging straps assembled onto the rail profiles of a backpack by the user to provide the backpack with additional carrying abilities of various tools.
Figure 5B:
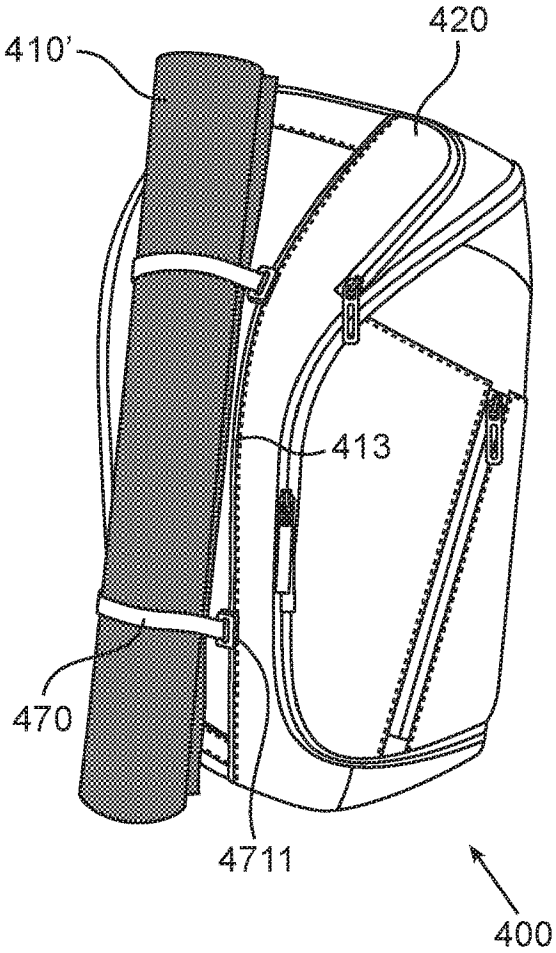
Figure 5A:
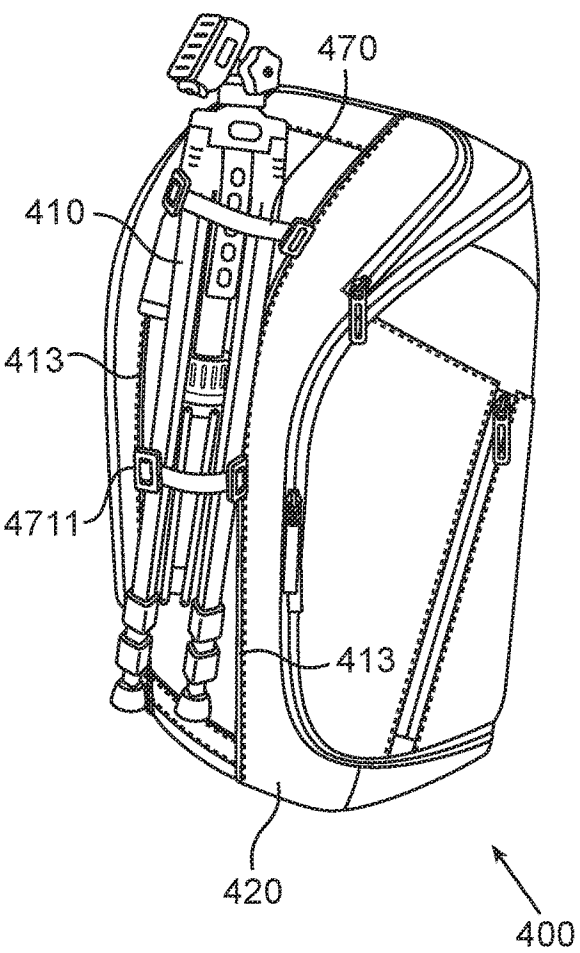

FIGS. 5A-5C are some optional examples of usage of the rail profiles of the invention as a platform to attach elastic straps 470 for hanging on the backpack variety of objects such as tripod 410, exercise mat 410', and helmet 410" respectively. In all examples, the elastic strap 470 comprises a buckle 4711 at each of the ends of the elastic strap 470 that adapted to be reversibly attached to the protruding rims 430 of two rail profiles 420. The elastic strap may tighten the object to the backpack from the outer surface of the object or can be inserted through an opening of the object to further secure the object, in one additional embodiment, elastic strap 470 may be attached to a single protruding rim 430 at one end and to accessory at the other end. In further variation, the elastic strap 470 may be used to decorate the bag and for example may have beads threaded on it.

Figure 6C:
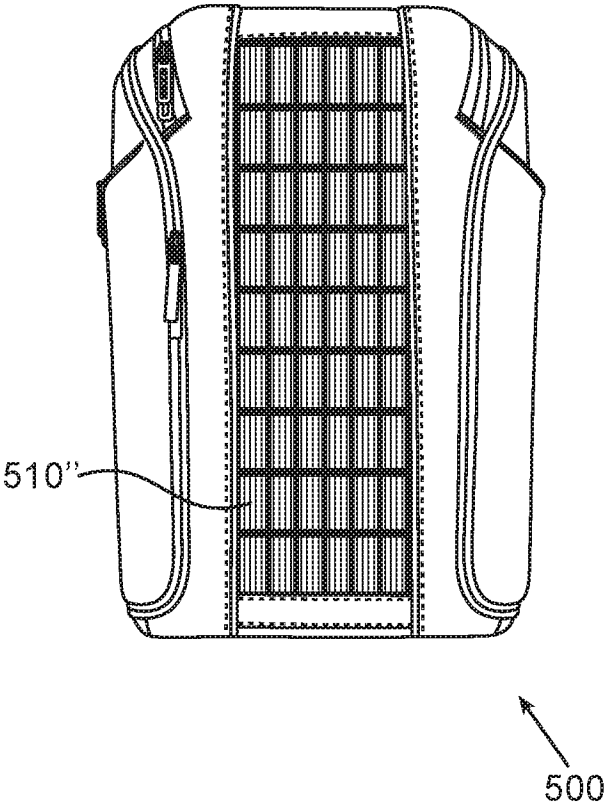
Figure 6B:
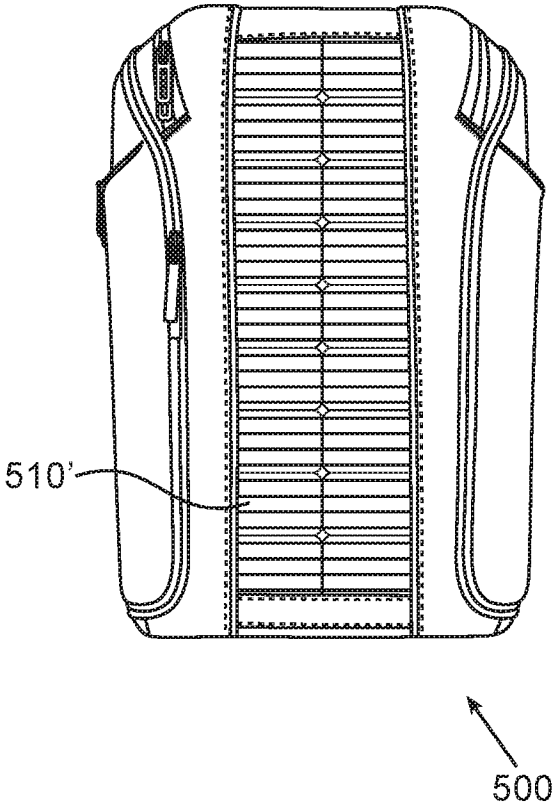
Figure 6A:
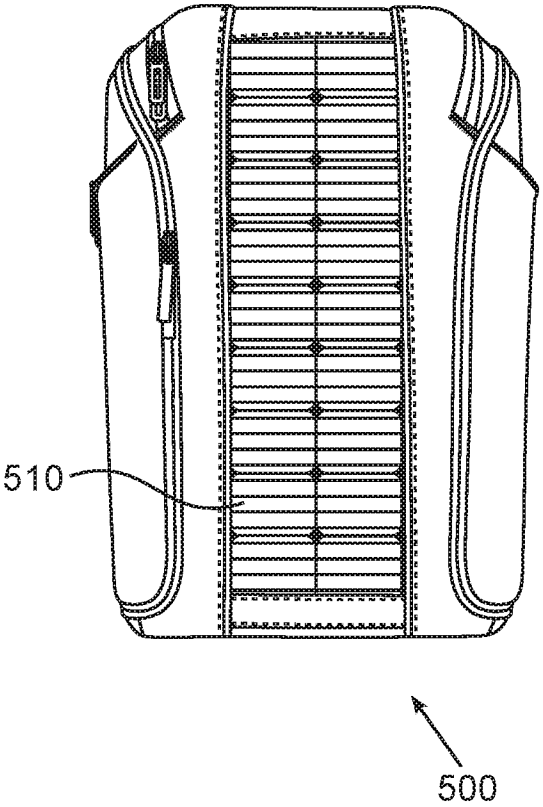

FIGS. 6A-6C are illustrations of various examples of different patterns of a solar replaceable panels 510,510', and 510" inserted into backpack 500, wherein, FIG. 6A illustrates, replaceable panel 510 having horizontal solar cells with a graphical picture of a net of lines separating between the cells; FIG. 6B illustrates replaceable panel 510' having horizontal solar cells configuration; and FIG. 6C illustrates replaceable panel 510" having a vertical solar cells configuration.

It should be clear that the description of the embodiments and attached Figures set forth in this specification serves only for a better understanding of the invention, without limiting its scope. It should also be clear that a person skilled in the art, after reading the present specification could make adjustments or amendments to the attached Figures and above described embodiments that would still be covered by the present invention.

What is claimed is:

1. A multi-functional replaceable panel assembly for a bag allowing a user to add a functionality to the bag and/or to vary its appearance, said multifunctional replaceable panel assembly comprising:

a. at least two rail profiles, each rail profile is attached to a bag and comprises at least one elongated strip that is made of at least one flexible material, wherein upon attachment of the elongated strip to the bag, a protruding rim is created at the interface between each one of the elongated strips and the bag, said protruding rims are positioned one toward the other to functionally allow inserting and holding of a replaceable panel below them; and, b. at least one replaceable panel having dimensions suitable to be inserted into the space created between said two protruding rims of the at least two rail profiles and the bag, wherein said replaceable panel is stably being held by the two protruding rims and provides the bag with additional functionality and/or a different appearance;

wherein, the same or different panel are replaced by the user according to his need upon usage.

2. The multi-functional replaceable panel assembly of claim 1, wherein said elongated strip is stitched to the bag's fabric.

3. The multi-functional replaceable panel assembly of claim 1, wherein said elongated strip is made of a flexible polymer covered with a fabric.

4. The multi-functional replaceable panel assembly of claim 1, wherein said panel comprises one or more of the following features: solar panel for charging, light reflector for darkness hours, colored panel for decoration, panel with a pattern for decoration, panel with letters for personalization; panel with hanging loops, panel with flash light, a panel with a case, a panel with a flexible LCD like display, and a panel with a clock.

5. The multi-functional replaceable panel assembly of claim 1, wherein said at least two rail profiles are positioned on the outer surface of the bag.

6. The multi-functional replaceable panel assembly of claim 1, wherein said at least two rail profiles are positioned on any wall of the bag.

7. The multi-functional replaceable panel assembly of claim 1, wherein said at least two rail profiles are integrated to the bag structure or separated therefrom.

8. The multi-functional replaceable panel assembly of claim 1, wherein said distance between the rail profiles vary in width and length.

9. The multi-functional replaceable panel assembly of claim 1, wherein said at least two rail profiles are detachable strips that can be positioned onto the bag in various distances to match different sizes of panels.

10. The multi-functional replaceable panel assembly of claim 1, wherein at least one of the elongated strips of said rail profiles further allows the attachment of accessories.

11. A bag comprising a multi-functional replaceable panel assemble according to claim 1.

12. A modular bag comprising a multi-functional replaceable panel assembly allowing a user to add a functionality to the bag and/or to vary its appearance, said multifunctional replaceable panel assembly comprising:

a. at least two rail profiles, each rail profile is attached to a bag and comprises at least one elongated strip that is made of at least one flexible material, wherein upon attachment of the elongated strip to the bag, a protruding rim is created at the interface between each one of the elongated strips and the bag, said protruding rims are positioned one toward the other to functionally allow inserting and holding of a replaceable panel below them; and b. at least one replaceable panel having dimensions suitable to be inserted into the space created between said two protruding rims of the at least two rail profiles and the bag, wherein said replaceable panel is stably being held by the two protruding rims and provides the bag with additional functionality and/or a different appearance;

wherein, the same or different panel are replaced by the user according to his need upon usage.

13. The modular bag of claim 12, wherein said elongated strip of the rail profile is stitched to the bag's fabric.

14. The modular bag of claim 12, wherein said elongated strip of the rail profile is made of a flexible polymer covered with a fabric.

15. The modular bag of claim 12, wherein said at least two rail profiles are integrated to the bag structure or separated therefrom.

16. The modular bag of claim 12, wherein the distance between the rail profiles varies in width and length.

17. The modular bag of claim 12, wherein said at least two rail profiles are detachable strips that can be positioned onto the bag in various distances to match different sizes of panels.

18. The modular bag of claim 12, wherein at least one of the elongated strips of the rail profiles further allows the attachment of accessories.

* * * * *